United States Patent [19]

Korte

[11] 4,417,685

[45] Nov. 29, 1983

[54] ERECTABLE CARTON WITH ADHESIVE RELEASE

[75] Inventor: Ralph J. Korte, Darien, Ill.

[73] Assignee: Champion International Corporation, Stamford, Conn.

[21] Appl. No.: 314,951

[22] Filed: Oct. 26, 1981

[51] Int. Cl.[3] ..... B65D 5/36; B65D 5/42

[52] U.S. Cl. ..... 229/41 B; 229/48 R

[58] Field of Search ..... 229/48 R, 48 SA, 41 R, 229/41 B

[56] References Cited

U.S. PATENT DOCUMENTS

| | | | |
|---|---|---|---|
| 1,698,908 | 1/1929 | Cleveland | 229/48 R |
| 1,947,664 | 2/1934 | Staude | 229/48 R |
| 2,173,989 | 9/1939 | Wilbur | 229/48 SA |
| 2,569,964 | 10/1951 | Waters | 229/48 R |
| 2,874,891 | 2/1959 | Kelsall | 229/48 R |

*Primary Examiner*—Herbert F. Ross

*Attorney, Agent, or Firm*—Evelyn M. Sommer; William W. Jones

[57] ABSTRACT

The carton is machine formed into a flattened erectable configuration by folding and gluing a paperboard blank. The flattened configuration is later erected by a suitable machine and the contents are inserted into the carton and the carton is closed. In order to ensure that glue oozing from the glue seam does not interfere with the erecting of the carton, a layer of glue release varnish is applied to the inside surface of the carton opposite the glue seam. In this manner, any glue which may ooze from the glue seam during formation of the flattened form will not stick to the opposite inside surface of the flattened carton and will not prevent expansion of the flattened form to the erected form.

8 Claims, 3 Drawing Figures

ERECTABLE CARTON WITH ADHESIVE RELEASE

This invention relates to a paperboard carton which is formed into a flattened bulk shipment form by folding and gluing a pre-cut, scored paperboard blank, with the ends of the folded blank being joined by an overlapped glue seam. More particularly, this invention relates to a carton as described above which includes a coating of glue release material on the inner surface of the carton opposite the glue seam to prevent glue which may ooze from the glue seam from securing the carton in the flattened form.

Paperboard cartons are conventionally formed from pre-cut and scored paperboard blanks which are folded and glued into a flattened form or configuration which is suitable for bulk shipment from the point of manufacture to the point of filling. At the point of filling the cartons are expanded from the flattened form to an erected form wherein the contents of the carton are inserted therein. The expansion operation is typically performed by a carton expanding machine. When the blank is folded and glued to form the flattened configuration, the ends of the blank are overlapped to form a glue seal with glue being applied to one of the overlapped glue flaps on the ends of the blank. The glue flaps are then pressed together by a machine to form the glue seam and secure the flattened form of the carton.

One problem which has arise in connection with the formation of the flattened form of the carton concerns the oozing of glue out of the edges of the glue seam when the glue flaps are pressed together by the machine. Any glue which thus oozes out of the glue seam is free to contact the opposite surface of the inside of the flattened carton so that opposite inner surfaces of the carton may inadvertently be glued together. When this happens, the carton expanding machinery will be unable to perform its function of expanding the carton from the flattened to the erected form. This invention solves this problem by placing a coating of glue release material on the inside surface of the carton opposite the glue seam. Thus, when the blank is folded and glued into the flattened form, any glue which may ooze from the glue seam will contact the glue release coating and the latter will act to prevent the opposite sides of the carton from becoming secured together. Thus the flattened form of the carton will be easily expanded to its erected form by the carton expanding machinery.

It is, therefore, an object of this invention to provide an improved paperboard carton construction of the type wherein the carton is formed into a flattened bulk shipping configuration by folding and gluing a pre-cut scored paperboard blank.

It is a further object of this invention to provide a paperboard carton construction of the character described wherein the flattened form of the carton is formed by gluing opposite ends of the blank together.

It is an additional object of this invention to provide a paperboard carton construction of the character described wherein provision is made for preventing accidental adherance of the opposed inside surfaces of the flattened form together by glue which may ooze from the glue seam when the flattened form is constructed.

It is another object of this invention to provide a paperboard carton construction of the character described wherein a glue release material layer is applied to an appropriate inner surface of the carton to prevent adherance in the flattened form.

These and other objects and advantages of the invention will become more readily apparent to those skilled in the art from the following detailed description of a preferred embodiment of the invention taken in conjunction with the accompanying drawings, in which.

Figure 1:
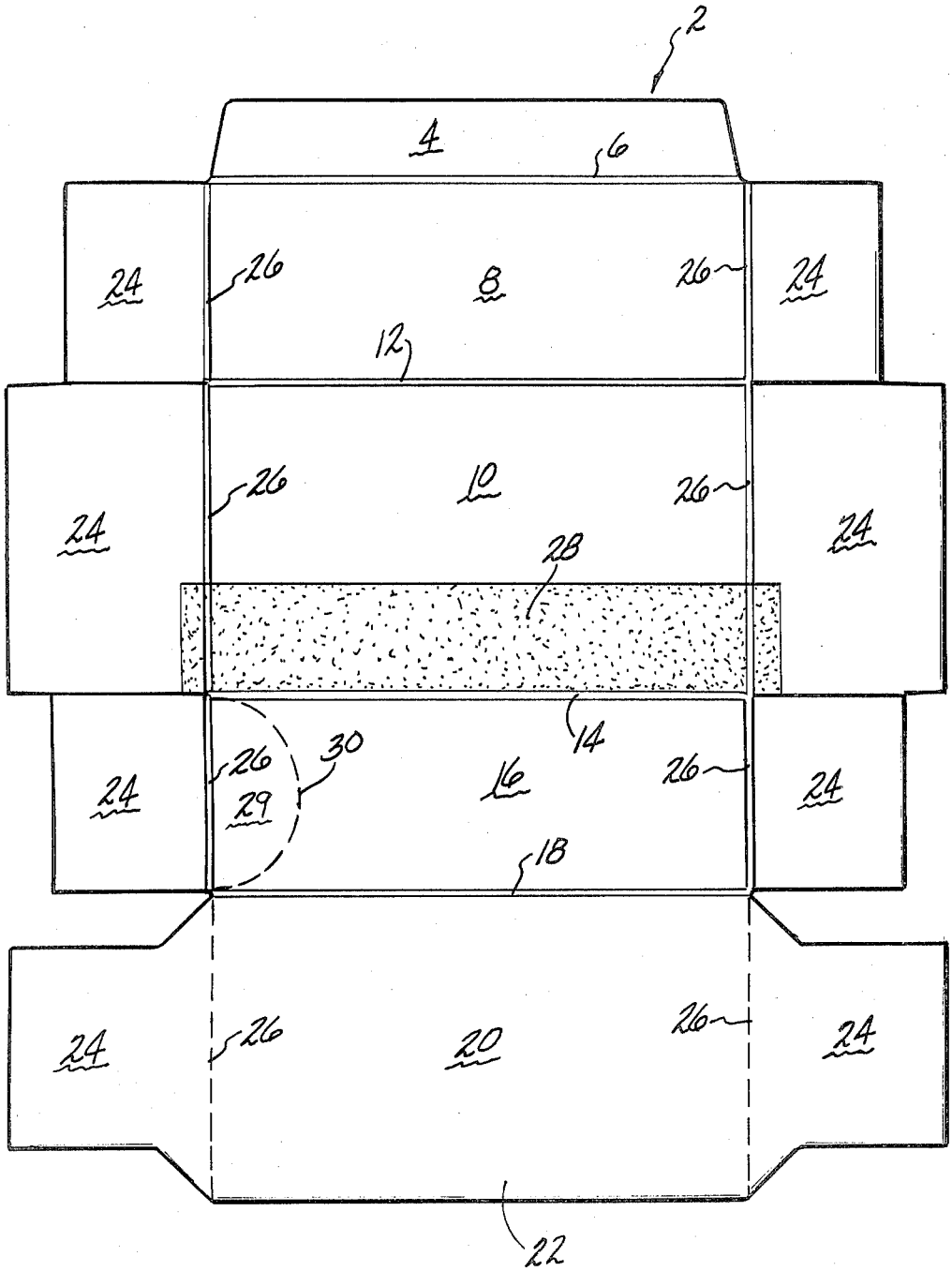
FIG. 1 is a plan view of the inside surface of a pre-cut, scored paperboard blank suitable for making a preferred embodiment of the carton of this invention.

Referring now to the drawings, there is shown in FIG. 1 a preferred embodiment of a pre-cut, scored paperboard blank, denoted generally by the numeral 2, suitable for folding and gluing to form a preferred embodiment of a carton in accordance with this invention, the inner surface of the blank 2 being shown in FIG. 1. The blank 2 comprises a first glue flap 4 at one end thereof, which glue flap 4 is connected by means of a score line 6 to a first side panel 8. The side panel 8, in turn, is connected to a front or back panel 10 by means of a score line 12. The panel 10 is connected by means of a score line 14 to a second side panel 16, which in turn, is connected by means of a score line 18 to a second front or back panel 20. The outer free edge of the panel 20 forms a second glue flap 22 for the blank 2. A plurality of end closure flaps 24 are connected to opposite ends of the panels 8, 10, 16 and 20 by means of score lines 26. An entry flap 29 is formed in the panel 16 by means of an arcuate score line 30. A layer of glue release varnish is printed onto the surface of the panel 10 which is shown as a stippled area 28 in FIG. 1. The release varnish used will be an oil varnish if offset printing equipment is used to apply the coating, or it will be a water base or solvent varnish if gravere printing equipment is used to apply the coating.

Figure 2:
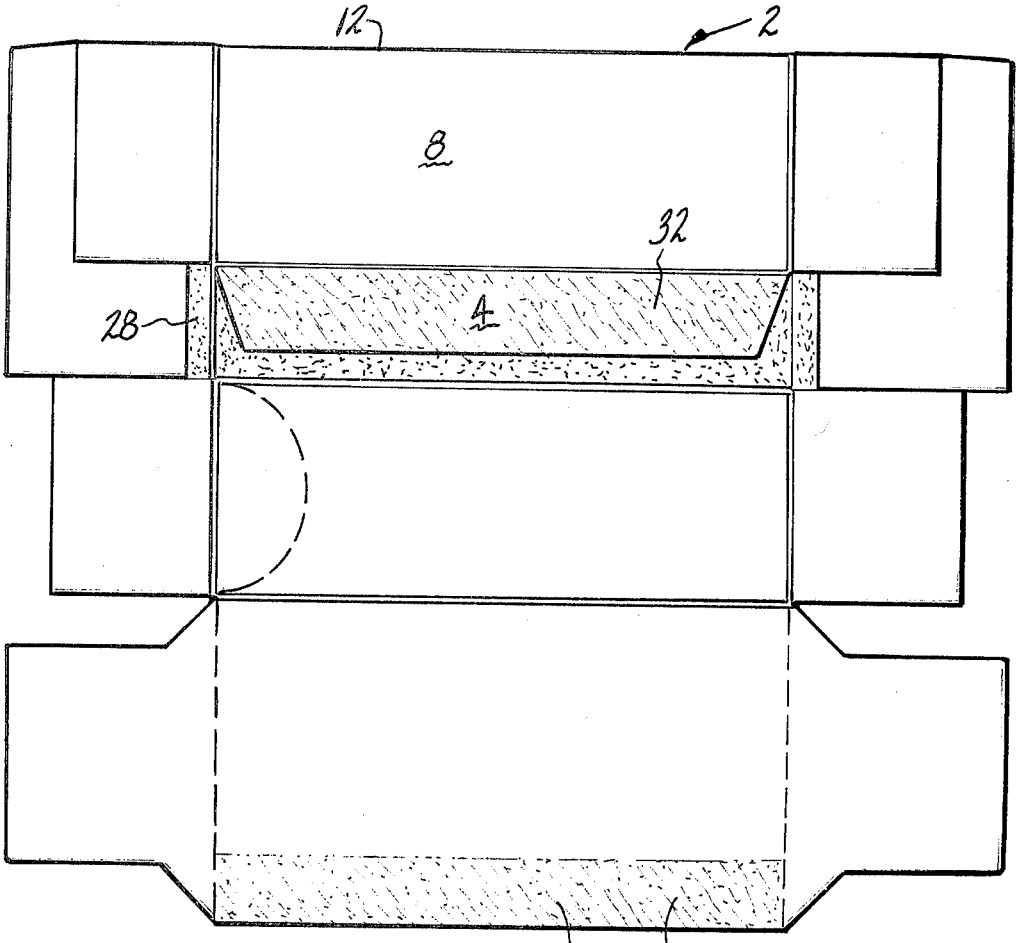
FIG. 2 is a plan view of the blank of FIG. 1 shown after the first folding operation has been performed preliminary to forming the flattened configuration of the carton.

Referring now to FIG. 2, the initial folding operation for forming the flattened carton configuration from the blank 2 is shown. The side panel 8 and glue flap 4 are folded about the score line 12 so that the glue flap 4 overlies the glue release varnish coating 28. Glue may be applied to the glue flap 4 or to the glue flap 22, where shown as cross hatched areas 32, preparatory to glueing the flaps 4 and 22 together. It will be noted from FIG. 2 that all free edges of the glue flap 4 are surrounded by the underlying glue release varnish coating 28. All conventional adhesives normally utilized for carton construction, could be successfully released, with this adhesive release varnish.

Figure 3:
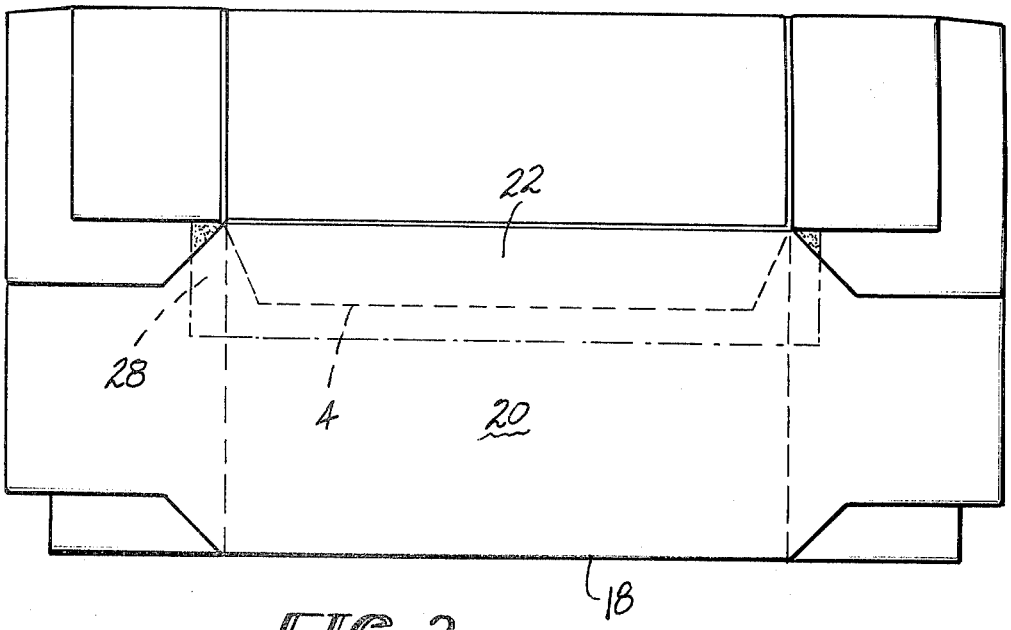
FIG. 3 is a plan view of the blank of FIG. 2 shown after the final folding operation has been performed to form the flattened configuration of the carton.

Referring now to FIG. 3, the final folding operation for forming the flattened form of the carton is shown. The panel 20 and glue flap 22 are folded about the score line 18 to bring the glue flap 22 into overlying juxtaposition with the glue flap 4. It will be noted that any glue which may ooze out of the resultant glue seam will contact the glue release varnish coating 28. Thus, any glue which may ooze out of the glue seam after the latter is formed will not cause the sticking together of opposite panels of the flattened carton. As a result, the flattened carton will be easily expandable by the carton erecting machinery so that articles or the like can be inserted into the carton.

It will be readily appreciated that this invention provides an efficient and inexpensive solution to the problem of sticking together of the opposite sides of the flattened form of a paperboard carton. The resulting carton can be readily expanded by the carton erecting machinery with no problems.

Since many changes and variations of the disclosed embodiment of the invention may be made without departing from the inventive concept, it is not intended to limit the invention otherwise than as required by the appended claims.

What is claimed is:

1. A paperboard carton which is expandable to an operable form from a flattened bulk shipping form said carton comprising:

(a) a plurality of side panels connected to each other along parallel bending score lines and a pair of end closure flaps foldably connected to each side panel, said panels being disposed in face-to-face juxtaposition when said carton is in said flattened form;

(b) a glue seam formed on said carton by overlapping glue flaps disposed on opposite ends of a blank from which said carton is formed, an innermost one of said glue flaps lying in face-to-face contact with a portion of the inside surface of one of said side panels when said carton is in said flattened form; and (c) a coating of glue release material completely coating said portions of said inside surface of said one of said side panels on said carton in an area lying adjacent to said glue seam when said carton is in said flattened form, said glue release material extending outwardly of each end of said one of said panels and onto respective end closure flaps to prevent oozing glue from adhering said glue seam to said inside surface of said one of said side wall panels on said carton whereby said carton may be readily expanded from said flattened form.

2. The carton of claim 1, wherein said glue release material is an oil varnish.

3. The carton of claim 1, wherein said glue release material is a water base varnish.

4. The carton of claim 1, wherein said glue release material is a solvent varnish.

5. A paperboard blank operable to be folded and glued to form a flattened expandable paperboard carton, said blank comprising:

(a) a plurality of side panels each having a pair of end closure flaps;

(b) a plurality of score lines interconnecting adjacent ones of said side panels;

(c) a pair of glue flaps disposed on opposite ends of said blank, said glue flaps being operable to be overlapped and glued together to form a glue seam for a flattened configuration of the carton;

(d) a coating of glue release material disposed upon the entire length of the inside surface of one of said side panels on said blank, said coating being positioned so that an innermost one of said glue flaps will overlie said coating when said blank is folded about a selected one of said score lines to form said flattened configuration of the carton, said coating extending beyond the length of said one of said side panels and onto respective end closure flaps whereby said glue release material will prevent glue oozing from said glue seam from adhering to said inside surface of said blank.

6. The blank of claim 5, wherein said glue release material is an oil varnish.

7. The blank of claim 5, wherein said glue release material is a water base varnish.

8. The blank of claim 5, wherein said glue release material is a solvent varnish.

* * * * *